United States Patent [19]

Suyama

[11] 4,360,076

[45] Nov. 23, 1982

[54] MUFFLER

[75] Inventor: Eizo Suyama, Mitaka, Japan

[73] Assignee: Nihon Rajieeta Kabushiki Kaisha (Nihon Radiator Co., Ltd.), Tokyo, Japan

[21] Appl. No.: 13,596

[22] Filed: Feb. 21, 1979

Related U.S. Application Data

[63] Continuation of Ser. No. 780,626, Mar. 23, 1977, abandoned.

[30] Foreign Application Priority Data

| | | | |
|---|---|---|---|
| Mar. 24, 1976 | [JP] | Japan | 51-34476 |
| Apr. 2, 1976 | [JP] | Japan | 51-39471 |
| Apr. 26, 1976 | [JP] | Japan | 51-51191 |
| May 12, 1976 | [JP] | Japan | 51-58853 |
| May 19, 1976 | [JP] | Japan | 51-62568 |

[51] Int. Cl.[3] ..... F01N 1/08

[52] U.S. Cl. ..... 181/265; 181/269; 181/272

[58] Field of Search ..... 181/264–266, 181/268, 269, 272, 252, 247, 255–258, 275, 276

[56] References Cited

U.S. PATENT DOCUMENTS

| | | | |
|---|---|---|---|
| 3,003,578 | 10/1961 | Ewashuk | 181/265 |
| 3,166,382 | 1/1965 | Purse et al. | 181/276 X |
| 4,122,914 | 10/1978 | Suyama | 181/258 |
| 4,192,401 | 3/1980 | Beaver et al. | 181/266 |

*Primary Examiner*—L. T. Hix
*Assistant Examiner*—Benjamin R. Fuller
*Attorney, Agent, or Firm*—Blum, Kaplan, Friedman, Silberman & Beran

[57] ABSTRACT

A muffler of the expansion type comprises an inlet pipe and an outlet pipe connected with each other through a main body. Minimization of pressure pulsation is achieved by a variety of means including appropriately-located apertures in those portions of the walls of said pipes within said main body, an apertured partition within said main body so located that exhaust gas passes through said partition, and appropriate tapering of said pipes. A foamed, heat-resistant material may be positioned over said apertures in said walls of said pipes. Pipe constructions suitable for mass production and pipe-to-main body constructions free of the danger of separation during prolonged use are shown.

14 Claims, 29 Drawing Figures

MUFFLER

This is a continuation of application Ser. No. 780,626, filed Mar. 23, 1977, now abandoned.

BACKGROUND OF THE INVENTION

The present invention relates to a muffler, and more particularly, to a muffler of the expansion type for use with an engine of an automobile and the like.

Heretofore a muffler of the expansion type has been used for muffling the sound of the exhaust gas of the engine, the pressure of which varies in pulsating manner, wherein the exhaust gas is first expanded and then contracted in traversing the muffler.

However, such a prior art muffler of the expansion type has the disadvantage that extraneous noise will be emitted from the outlet pipe rapid acceleration or rapid deceleration of the engine, although the muffler may be effective under normal driving conditions. Further, the muffler may generate extraneous noise depending upon the position thereof with respect to the engine, even though the above mentioned disadvantage is avoided.

In the prior art muffler of the expansion type, when the exhaust gas introducing pipe is formed, many working steps are required, such steps including pipe diameter throttling, welding and the like, so that manufacture of the exhaust gas introducing pipe or muffler becomes troublesome. Also, during operation of the muffler, damage to the exhaust gas introducing pipe is cuased as the result of working stress therein, the heat of the exhaust gas and the like leading to failure of the muffling effect and the life of the muffler will become short.

Further, in the prior art muffler of the expansion type, the securing of the exhaust gas conducting pipes to the main body of the muffler could not be made rigid, so that the pipes tended to detach from the mating recesses or the mating cylindrical flanges of the main body of the muffler. Also, when the pipes were secured to mating portions by welding, the welding operation was very troublesome, so that the welded portions suffered from being broken or the pipes might be jolted or separate from the mating portions due to severe vibration of the main body of the muffler, the thermal expansion of the main body resulting from the passage of high temperature exhaust gas through the muffler or the failure of the welded portions in the fixing construction of the pipes.

SUMMARY OF THE INVENTION

The present invention aims at avoiding the above mentioned disadvantages and providing a muffler having superior performance.

An object of the present invention is to provide a muffler of the expansion type for the exhaust gas of an engine generating pulsating noise, which can efficiently muffle the noise of the exhaust gas.

Another object of the present invention is to provide a muffler of the expansion type having the above mentioned characters, while it is simple in construction.

A further object of the present invention is to provide a muffler having the above mentioned character, while it has less number of process adapted for mass production, and yet being durable.

A still further object of the present invention is to provide a muffler having the above mentioned character, while it has simple fixing constructions capable of rigidly securing the ends of the exhaust gas conducting pipes to the end plates or the partitions of the main body of the muffler.

Other objects and the characteristic features of the present invention will be apparent from the following description, when read in connection with the accompanying drawings.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 28 and FIG. 29 are sectional views showing the fixing construction for the exhaust gas conducting pipe of the muffler of the present invention, wherein FIG. 28 shows the state prior to the caulking operation, while FIG. 29 shows the state after the caulking operation.

DESCRIPTION OF THE PREFERRED EMBODIMENTS

Figure 1:
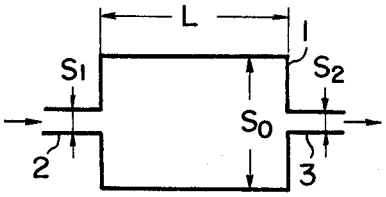
FIG. 1 PRIOR ART
FIG. 1 is a schematic sectional view showing the basic construction of a muffler of the expansion type.
Figure 5:
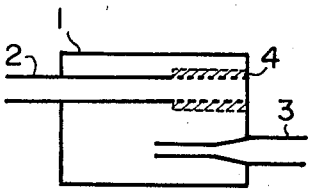
FIG. 5 is a schematic sectional view showing the basic construction of an embodiment of the muffler constructed in accordance with the present invention.
Figure 2:
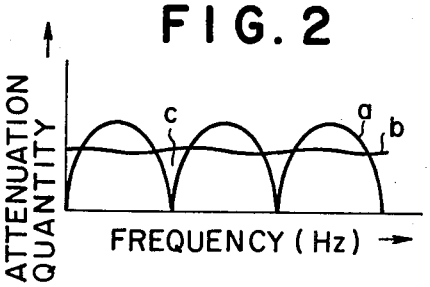
FIG. 2 is a diagram showing the damping of the sound pressure.

FIG. 1 shows the basic construction of a prior art muffler of the expansion type for muffling the noise of exhaust gas from an engine, in which the pressure of the exhaust gas is pulsatingly vartied by expanding and then contracting the same. The basic construction is such that an inlet pipe 2 having a cross-sectional area $S_1$ and an outlet pipe 3 having a cross-sectional area $S_2$ are connected to a main body 1 having a cross-sectional area $S_o$ and a length of L. When the exhaust gas is fed into the body 1 through the inlet pipe 2, it expands in the body 1 and when it passes into the outlet pipe 3, it contracts. Thus, as shown in FIG. 2, the variation of the acoustic or sound pressure is damped (attenuated) from the curve a to the curve b. The maximum value of the damping of the sound pressure is determined by the ratio among the cross-sectional areas $S_o$, $S_1$ and $S_2$.

In order to further enhance the muffling effect by increasing the damping value of the sound pressure, i.e. by making the trough at the portion c in FIG. 1 shallower, it is known to be effective to extend the inlet pipe 2 or the outlet pipe 3 into the interior of the main body 1.

Figure 3:
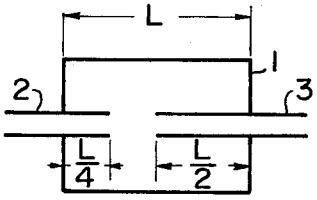
FIG. 3 PRIOR ART
FIG. 3 and FIG. 4 are schematic sectional views showing prior art mufflers of the expansion type.

FIG. 3 shows a muffler of the prior type, in which the above-mentioned result is incorporated and in which the inlet pipe 2 is extended into the main body 1 by the length of L/4 (the value being corrected with respect to the open end effect thereof), and the outlet pipe 3 is extended into the main body 1 by the length of L/2. With this construction, the muffling effect is adequate under the normal operating condition of the engine, but it has disadvantages in that extraneous noise is generated during rapid acceleration and retardation of the engine.

Figure 4:
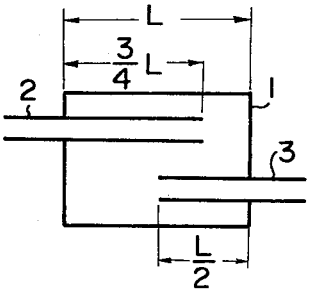
FIG. 4 PRIOR ART

The muffler of the type shown in FIG. 4 is so constructed that the inlet pipe 2 extends into the body 1 by the length of $\frac{3}{4}$ L, while the outlet pipe 3 extends into the body 1 by the length of L/2. In this construction, the disadvantages of the muffler shown in FIG. 3 are decreased somewhat, but extraneous noise may be generated depending upon the position of the muffler with respect to the engine.

Embodiments of mufflers constructed in accordance with the present invention as shown in FIGS. 5 to 8, wherein an impedance member 4 is attached to the portion of the inlet pipe 2 from which the exhaust gas flows out so that the performance of the muffler is improved over that of the prior art muffler.

Figure 6:
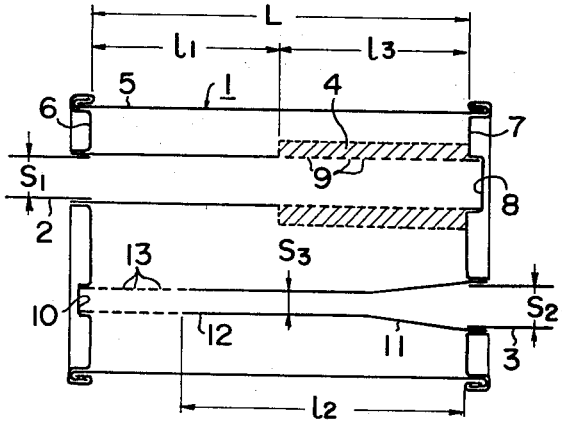
FIG. 6 is a sectional view showing an embodiment of the muffler of the present invention.

In the construction shown in FIG. 6, the main body 1 is formed as a cylindrical body 5 (circular cross-section, elliptical cross-section, etc.) closed at both ends thereof by end plates 6, 7, respectively. The inlet pipe 2 passes through the front end plate 6 and the end of the inlet pipe 2 is fitted in a recess 8 formed in the rear end plate 7 so as to be supported thereby, while a plurality of holes 9 are formed in the inlet pipe 2 at the portion thereof spaced by the length $l_1$ from the front end plate 6 and an impedance member 4 is mounted outside of the portion where the holes 9 are formed. The impedance member 4 in this example is a tube of heat resistant, sound-absorbant, gas-permeable material which is formed by pressing alumina powder integrally. The outlet pipe 3 passes through the rear end plate 7 and the entrance end thereof is fitted in a recess 10 formed in the front end plate 6 so as to be supported thereby. The downstream portion of the outlet pipe 3 having the length of $l_2$ extending from the rear end plate 7 into the main body 1 is unperforated and a tapered portion 11 of said downstream portion expands from a reduced diameter portion 12 having the cross-sectional area $S_3$. The section of the reduced diameter portion 12 adjacent to the front end plate 6 is formed with a plurality of holes 13. Assuming $S_1 \geqq S_2 \geqq S_3$, the relation among the lengths L, $l_1$ and $l_2$ is preferably one of the following:

$l_1 = \frac{1}{2}L,\ l_2 = \frac{3}{4}L;$ $l_1 = \frac{1}{2}L,\ l_2 = \frac{1}{4}L;$ $l_1 = \frac{3}{4}L,\ l_2 = \frac{1}{2}L;$ and $l_1 = \frac{1}{4}L,\ l_2 = \frac{1}{2}L.$ By constructing the muffler as described above, it is possible to obtain a muffler, in which the performance thereof is further improved over the muffler of the type shown in FIG. 4, which is derived from the basic type shown in FIG. 1. The exhaust gas enters the main body 1 through the holes 9 in inlet pipe 2 and the impedance member 4 expanding in the process. The gas then enters the reduced diameter portion 12 through the holes 13 and smoothly flows out of the outlet pipe 3 through the tapered portion 11, the flow of the exhaust gas being rectified so that the pulsating variation in the sound pressure of the exhaust gas is decreased, thereby lowering the sound pressure itself and preventing extraneous sound during rapid acceleration of the engine, thus achieving a muffling effect superior to that of the prior art muffler.

Figure 7:
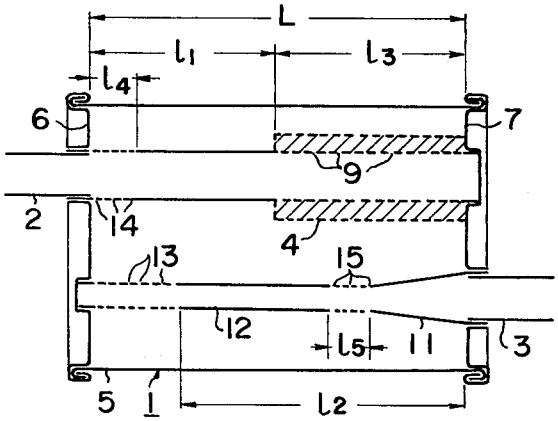
FIG. 7 and FIG. 8 are sectional views showing alternative examples of the muffler shown in FIG. 6.

FIG. 7 shows another example, similar to the embodiment of FIG. 6, and so constructed as to achieve the muffling effect obtainable by the embodiment of FIG. 6, while avoiding the increase in back pressure in the engine resulting from the employment of the impedance member. In FIG. 7, the holes 9 in the inlet pipe 2, the impedance member 4, the tapered portion 11 in the outlet pipe 3 and the reduced diameter portion 12 are provided in like manner to that of the embodiment of FIG. 6, but a group of holes 14 are formed in a portion of the inlet pipe 2 located in the main body 1 and extending by the length of $l_4$ from the front end plate 6. Also, a group of holes 15 are formed in a section of the reduced diameter portion 12 of the outlet pipe extending by the length of $l_5$ in the body 1. According to the result of experiments, the total sum of the cross-sectional areas of the respective holes must be less than the cross-sectional area of each of the pipes and the lengths $l_4$ $l_5$ must be limited so as not to exceed 60% of the diameter of the respective pipes, in order to achieve good results.

In the FIG. 7 example, a portion of the pulsating exhaust gas entering through the inlet pipe 2 leaves of the main body 1 without flowing through the impedance member 4, while a portion of the exhaust gas in the main body enters the outlet pipe 3 through the holes 15, so that increase in back pressure of the engine is prevented, while the muffling effect is enhanced by the interference with flow of the exhaust gas through the holes 9, 13, 14 and 15.

Figure 8:
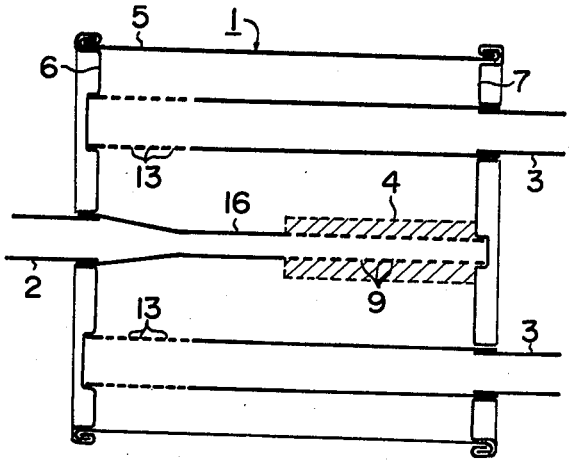

FIG. 8 shows a further variation of the embodiment of FIG. 6, wherein a reduced diameter portion 16 is formed in the inlet pipe 2. The side surface of the reduced portion 16 has a plurality of holes 9 therein, the holes being covered by an impedance member 4 in the form of a cylinder made of a heat-resisting, gas-permeable and sound-absorbing material. Also, a plurality of holes 13, 13 are provided in each of the outlet pipes 3, 3 for discharge the exhaust gas therethrough.

Other embodiments of mufflers according to the present invention are illustrated in FIGS. 9 to 12, wherein inlet pipe 2 is throttled within the main body 1, while small holes serving as impedance to the flow of the exhaust gas and short-circuit holes are provided therein and a plurality of holes are provided in the outlet pipe 3 so as to improve the performance thereof over the prior art muffler.

Figure 9:
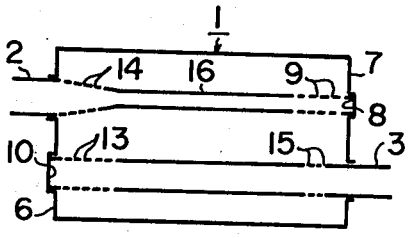
FIG. 9 is a sectional view showing another embodiment of the muffler of the present invention.

In the embodiment shown in FIG. 9, the inlet pipe 2 inserted into the main body 1 has a reduced diameter portion 16, the downstream end of which is fitted into a recess 8 formed in the rear end plate 7 of the main body so as to be supported thereby, the forward end of main body 1 being closed by the end plate 7. A plurality of small holes 9 serving as impedance are formed in the downstream end portion of the reduced diameter portion 16 and short-circuit holes 14 are formed in the upstream portion thereof extending into the main body, the upstream end of the outlet pipe 3 being likewise blocked by the front end plate 6 by fitting it in a recess 10 formed therein so as to be supported thereby, while a plurality of small holes 13 are formed at the upstream end portion of the outlet pipe 3 in the main body 1 and short-circuit holes 15 are formed at the downstream portion thereof.

The exhaust gas coming into the main body 1 through the inlet pipe 2 flows into the reduced diameter portion 16, is ejected therefrom into the main body 1, and is slightly throttled when passing through the small holes 9. The small holes 9 serve as impedance to the flow of the exhaust gas, thereby smoothing the pulsating flow thereof, a portion of the exhaust gas flowing directly into the main body 1 through the short-circuit holes 14 so that the increase in the flow resistance resulting from the flow through the small holes 9 is minimized. The exhaust gas flows from the main body flows into the outlet pipe 3 through the small hole 13 so that a further smoothing action is effected on the remaining pulsation by the flow resistance by of the small holes 13. A portion of the exhaust gas flows from the main body into the outlet pipe 3 through the short-circuit holes 15 so as to minimize the increase in the flow resistance resulting from the flow through the small holes 13.

In this construction, the effects of the contraction of the exhaust gas through the reduced diameter portion 16 in the inlet pipe 2, the expansion into the main body 1 through the small holes 9, and the contraction of during the flow into the outlet pipe 3 through the small holes 13 are cumulative and the flow resistance resulting from the flow of the exhaust gas through the small holes 9, 13 affords a good muffling effect. The short-circuit holes 14, 15 minimize the increase in the flow resistance generated when the exhaust gas flows through the small holes 9, 13, thereby preventing the back pressure of the engine from being increased.

Figure 10:
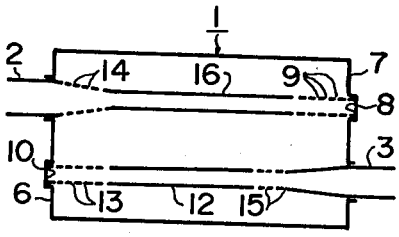
FIG. 10 to FIG. 12 are sectional views showing alternative examples of the muffler shown in FIG. 9.
Figure 11:
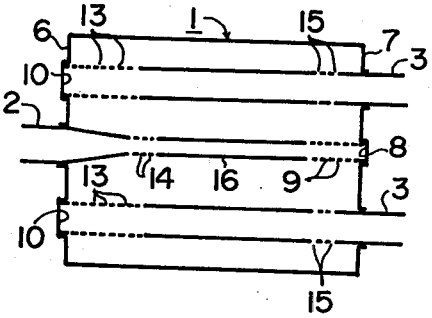
Figure 12:
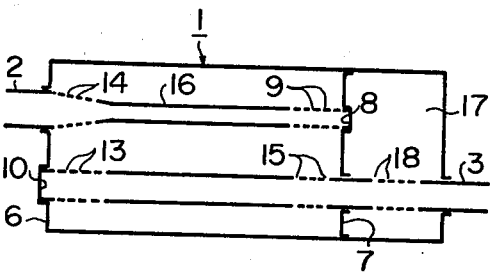

FIG. 10 shows example of the embodiment shown in FIG. 9, wherein the portion of the outlet pipe 3 located in the main body 1 is reduced in its diameter as in the case of the inlet pipe 2 so as to form a reduced diameter portion 12. FIG. 11 shows a further example of the embodiment of FIG. 9, wherein two outlet pipes 3 are provided. FIG. 12 shows yet another example of the embodiment of FIG. 9, wherein a further muffling mechanism is added to the basic configuration of the embodiment of FIG. 9. In this example, the main body 1 is extended outwardly beyond the end plate 7 so as to form a closed resonance chamber 17 and small holes 18 are formed in the outlet pipe 3 located in the chamber 17. The pulsation remaining in the exhaust gas of the engine existing from the outlet pipe 3 through the muffling portion is reduced by virtue of the resonance effect, which damps the sound pressure when a portion of the exhaust gas flows into and out of the chamber 17 through the holes 18. The embodiments illustrated in FIGS. 9 to 12 are so constructed that a reduced portion 16 is formed in the inlet pipe 2 inserted into the main body 1 and a plurality of small holes 9 serving as impedance to the flow of the exhaust gas and short-circuit holes 14 are provided in the reduced diameter portion 12 for transferring the engine exhaust gas therethrough into the main body 1. Also, the exhaust gas flows from the main body 1 into the outlet pipe 3 through the short-circuit holes 15. As the result of these construction features superior muffling effect is achieved without suffering from the disadvantages of the prior art types of mufflers, despite the fact that the construction of the muffler in accordance with the present invention is much simplified.

Figure 13:
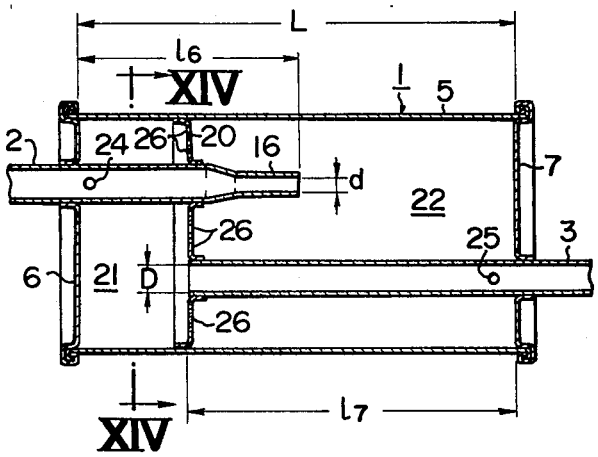
FIG. 13 is a sectional view showing a further embodiment of the muffler of the present invention.
Figure 14:
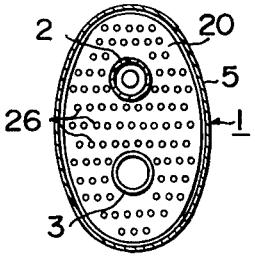
FIG. 14 is a sectional view taken along line XIV—XIV in FIG. 13.

FIG. 13 and FIG. 14 show a further embodiment of the muffler according to the present invention. In this embodiment, the main body 1 is divided into a front chamber 21 and a rear chamber 22 by a partition 20 attached to the outer cylinder 5 by such means as welding, and the inlet pipe 2 extends a distance $l_6$ from the front and plate 6 into the main body 1 so that it passes into the rear chamber 22 to communicate therewith. The pipe 2 is supported by the front end plate 6 and the partition 20, while the outlet pipe 3 extends a distance $l_7$ into the main body 1 from the rear end plate 7 to communicate with the front chamber 21 and it is supported by the rear end plate 7 and the partition 20. The portion of the inlet pipe 2 which is located in the rear chamber 22 has a reduced diameter portion 16, and short-circuit holes 24 are formed in the inlet pipe 2 at positions within the front chamber 21. Short-circuit holes 25 are formed in the outlet pipe 3 at positions in the rear chamber 22 and a plurality of small holes 26 serving as impedance to the flow of the exhaust gas are formed in the partition 20.

Since this embodiment is constructed as mentioned above, the exhaust gas coming through the inlet pipe 2 enters the reduced diameter portion 16, where it is slightly throttled and flows out of the extremity thereof into the rear chamber 22 and expanded. The pulsation of the exhaust gas in the rear chamber 22 is damped by virtue of the reflection by the rear end plate 7 and by the partition 20 which is provided with small holes 26 but has a high reflecting power resulting in interference; the exhaust gas flows into the front chamber 21 through the small holes 26. In this step, the small holes 26 act as impedance to the flow of the exhaust gas into the front chamber 21 so as to smooth the pulsating flow thereof. A portion of the exhaust gas in the inlet pipe 2 is ejected directly into the front chamber 21 through the short-circuit holes 24 to decrease the pressure loss caused by the passage of the exhaust gas through the reduced diameter portion 16 and small holes 26. Thus, the exhaust gas introduced into the front chamber 21 is subjected to the interference effect by the reflection of the exhaust gas occurring between the front end plate 6 and the partition 20 and flows into the outlet pipe 3, in which the gas is contracted as it is discharged from the main body.

The short-circuit holes 25 serve to reduce the pressure loss caused by the flow through the small holes 26 by introducing a portion of the exhaust gas in the rear chamber 22 directly into the outlet pipe 3 through the short-circuit holes 25.

Figure 15:
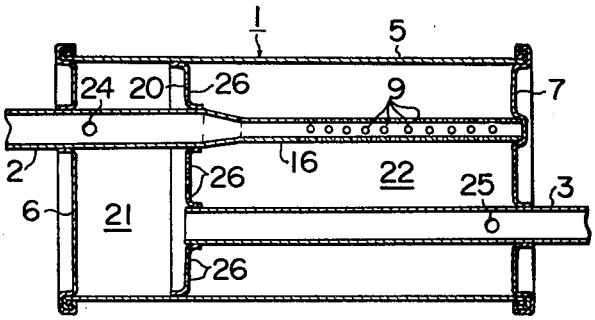
FIG. 15 is a sectional view showing an alternative example of the muffler shown in FIG. 13.

FIG. 15 shows an alternative example of the embodiment of FIG. 13, wherein the reduced diameter portion 16 of the inlet pipe 2 located in the rear chamber 22 is extended to the rear end plate 7 so that its end is engaged therewith so as to be supported thereby. The end portion of the reduced diameter portion 16 is provided with a plurality of small holes 9, thereby enhancing the muffling effect by providing the impedance of the reduced diameter portion 16 and the small holes 9 to the exhaust gas flowing into the front chamber 22 from the inlet pipe 2.

As mentioned above, in the embodiment shown in FIGS. 13 and 14 and the modifications thereof, the exhaust gas is subjected repeatedly to expansion and contraction and to an impedance effect by the small holes 26 so as to smooth the pulsating flow of the exhaust gas. In addition it is subjected to the interference effect of the reflection by the partition 20 thereby effectively muffling the exhaust gas. The provision of the short-circuit holes 24, 25 minimizes or eliminates the increase in the pressure loss caused by the passage of the exhaust gas through the reduced diameter portion 16 and the small holes 26 thereby preventing the back pressure on the engine from being increased.

According to experimental results obtained by the present inventor, the interference effect given by the partition 20 in the embodiment shown in FIG. 13 was found to be effective in improving the efficiency thereof when the following conditions are satisfied:

$$l_6 = \tfrac{1}{2}/L - 0.3\,d$$

$$l_7 = \tfrac{3}{4}/L - 0.3\,D$$

where:

L is the length of the main body,

D is the diameter of the outlet pipe 3, d is the diameter of the reduced diameter portion 16.

Figure 16:
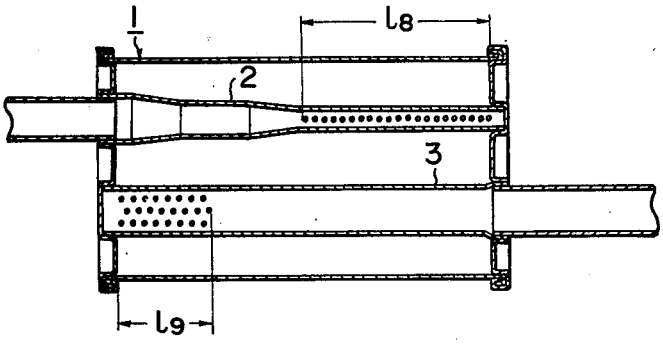
FIG. 16 shows a still further embodiment of the muffler according to the present invention, wherein an exhaust gas-introducing pipe is provided, said pipe being integrally formed with said muffler.

The present invention further relates to the construction features of the mufflers taught herein with regard to facilitating the construction and assuring a long, effective lifetime. Thus, FIG. 16 shows an embodiment of a muffler having a continuously and integrally-formed exhaust gas-introducing pipe, and, as in the above mentioned each embodiments, the exhaust gas passes through the inlet pipe 2, and expands within the main body of the muffler from a perforated portion of the required length; the gas then enters the exhaust pipe 3 through a perforated portion thereof to be exhausted outside.

Figure 17:
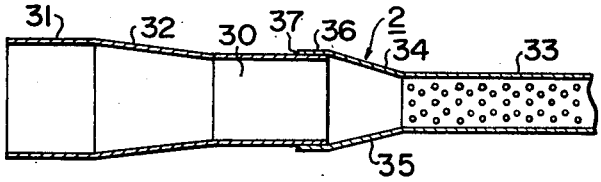
FIG. 17 PRIOR ART
FIG. 17 to FIG. 20 are sectional views showing the prior art exhaust gas introducing pipes.

The prior art exhaust gas-introducing pipes having an enlarged diameter portion, a throttled portion and a perforated portion, are formed as shown in FIG. 17 to FIG. 20. Inlet member 30 in FIG. 17 is an electro-unite tube which is preliminarily formed so as to provide an enlarged diameter portion 31 and a throttled portion 32. Member 33 is an electro-unite tube, perforated in part, and having an unperforated portion comprising a throttled portion 35 and an enlarged diameter portion 36. The electro-unite tube 30 is inserted into said enlarged diameter portion 36, then a portion 37 is welded to make an exhaust gas-introducing pipe. With this type of construction, it is necessary to effect diameter enlarging work and throttling work for a complete tube.

Figure 18:
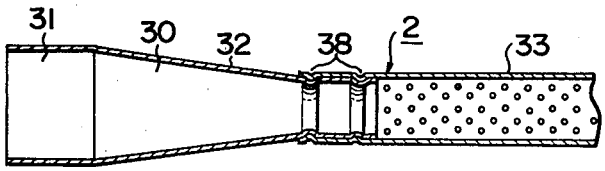
FIG. 18 PRIOR ART

FIG. 18 shows a structure in which a throttled portion 32 is inserted into a perforated portion 33, after which they are joined by caulking; no welding is required, however, a complicated joint portion 38 must be formed.

Figure 19:
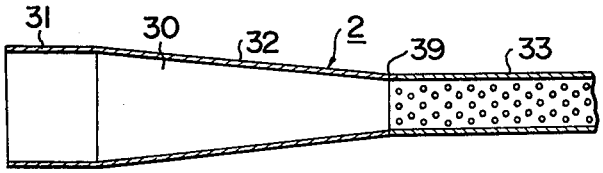
FIG. 19 PRIOR ART

FIG. 19 shows a structure in which an enlarged and throttled tube 30 and a perforated tube 33 are subjected to butt welding at a joint portion 39; however, the butt welding of an exhaust gas introducing pipe using thin plate needs skill.

Figure 20:
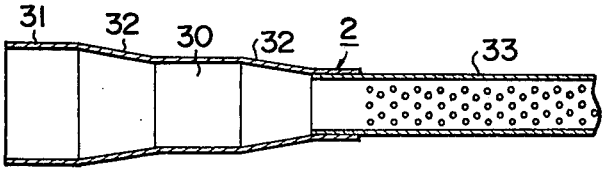
FIG. 20 PRIOR ART

FIG. 20 shows a structure in which a perforated tube 33 which is straight in shape and unthrottled is inserted into an electro-unite tube 30. In this case, the passage of said tube 30 is narrowed to reduce the percentage of enlarging and throttling of the diameter of said tube 30, but substantial labor is necessary for joining said tubes 30 and 33.

Thus, the exhaust gas introducing pipe of prior art types cannot avoid the requirement of a large number of man-hour for manufacturing pipes.

The exhaust gas-introducing pipe 2 embodied in the example shown in FIG. 16 is such that it can be fashioned from a long hoop strip provided with small holes of necessary area, which are distributed in necessary width along the longitudinal direction; the strip is pressed and formed into conducting half-pipes in longitudinal shapes, after two of the half-pipes are joined together, as shown in details in FIG. 21 to FIG. 24, thus providing for mass production as well as assuring a satisfactory muffling effect.

Figure 21:
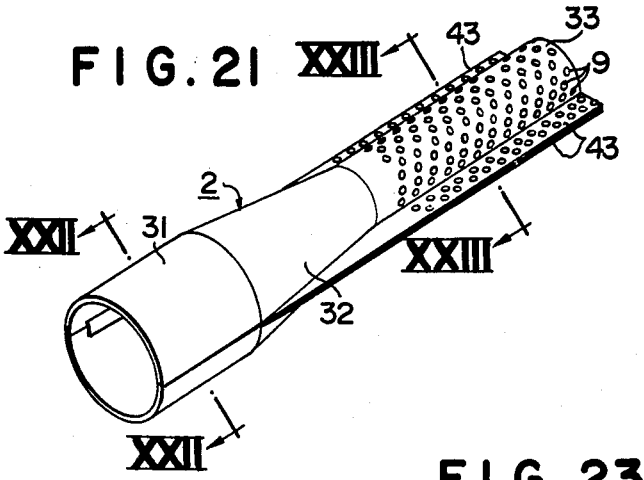
FIG. 21 is a perspective view of the exhaust gas introducing pipe used for the muffler shown in FIG. 16.
Figure 23:
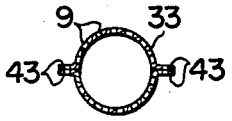
FIG. 23 is a sectional view taken along line XXIII—XXIII in FIG. 21.
Figure 22:
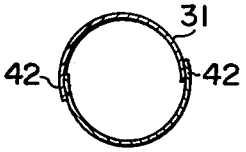
FIG. 22 is a sectional view taken along line XXII—XXII in FIG. 21.
Figure 24:
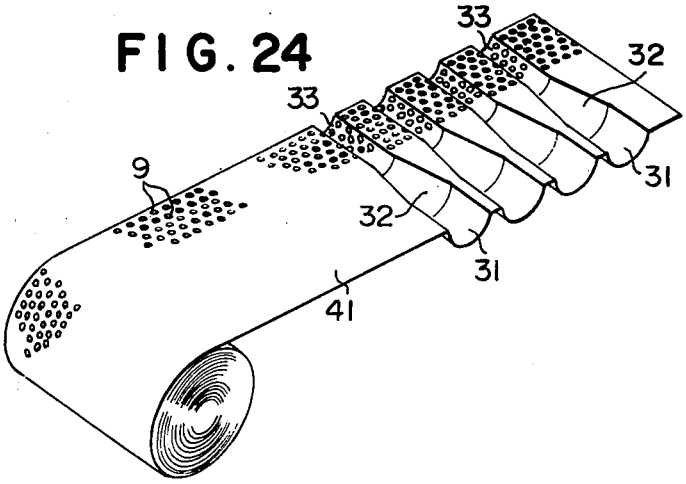
FIG. 24 is a schematic perspective view showing longitudinal halves of the exhaust gas introducing pipe shown in FIG. 21 in a stage of formation by continuous processing from a hoop steel by means of a press.

FIG. 21 is a perspective view of the complete exhaust gas introducing pipe, and FIG. 22 and FIG. 23 show sections along lines XXII—XXII and XXIII—XXIII of FIG. 21, respectively. FIG. 24 shows a long hoop steel strip as blank material at a stage in manufacturing process in which a portion thereof has been subjected to press forming.

Figure 25:
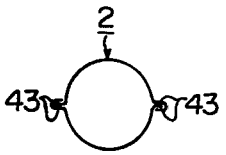
FIG. 25 and FIG. 26 are schematic sectional views showing the structure for longitudinal joints of flange portions of an exhaust gas introducing pipe.
Figure 26:
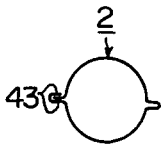

As is evident from FIG. 24, the hoop steel strip 41 having perforated and unperforated is fed to a press, the apertures having the reference numeral 9. Male and female dies (not shown) of a press are provided with profiles for forming the longitudinal halves of the exhaust gas introducing pipe shown in FIG. 21. Moving hoop steel strip is pressed to form the enlarged diameter portion 31, the throttled portion 32 and the perforated portion 33 at a stroke, after which it is cut to provide halves of exhaust gas introducing pipes. Subsequently, two of said halves are put together face to face and the enlarged diameter portions are joined at overlapped portions 42 as in FIG. 22. Alternatively the perforated portions are placed together with the flanges 43 in contact. The flanges are then spot welded, producing by a continuous process an exhaust gas-introducing pipe having the enlarged diameter portion 31, the throttled portion 32 and the perforated portion 33. The flanges 43 may be formed over the whole length of the pipe, but when they are formed only at reduced diameter portions as mentioned above and the enlarged diameter portions are put together at the lapped portions 42, a saving in material is effected. Further, in joining the flanges 43, spot welding, seam welding or rivetting may be used, or as seen in FIG. 25, one side of each flange is broadly formed to be bent and caulked, thus to clamp another side of flange. Yet another technique is shown in FIG. 26, two halves of the pipes are punched out of the hoop steel in one piece and folded at the connecting portion, then one of the flanges is bent and caulked or welded at the other end. Any of these techniques results in a strong, durable and effective muffler adapted for easy mass production.

Figure 27:
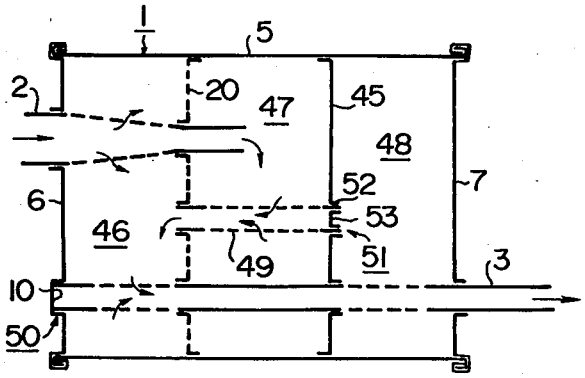
FIG. 27 is a sectional view showing the muffler of the expansion type having the prior art fixing construction for the exhaust gas conducting pipe.

The present invention further aims at the provision of a muffler to assure the above-mentioned muffling effect, by easily and rigidly connecting the ends of exhaust gas introducing pipe to the end plates or the partition plates. FIG. 27 shows an example of a muffler of the expansion type having the conventional fixing construction of the exhaust gas introducing pipe. In the embodiment shown, the numeral 1 designates a main body, wherein end plates 6, 7 are joined to the respective ends of the cylindrical body 5, the interior of which is divided into three chambers 46, 47, 48 by a partition 20 and a partition 45 having no holes. Numeral 2 designates the inlet pipe for the exhaust gas, 3 the outlet pipe, and 49 a porous pipe fixed so as to pass through the chamber 47 from chamber 46 to wall 45. The respective pipes 2, 3 and 49 are exhaust gas conducting pipes for conducting the exhaust gas into, out of and through the main body, respectively, and the pipes are passed through and end plate or the partition so as to be supported thereby.

In order to support and close the open end of the respective exhaust gas-conduting pipes, the end of the outlet pipe 3 may be fitted in a recess 10 formed in the end plate 6, as shown at 50 in FIG. 27, or the porous pipe 49 is passed through a cylindrical flange 52 formed in the partition 45, as shown at 51 in the same figure, a dish-shaped cap 53 is fitted on the end of the pipe 49, the cylindrical flange 52 and the cap 53 are welded or spot welded together around their entire periphery so as to secure them to each other.

In the prior art-fixing construction as mentioned above, however, since the exhaust gas conducting pipes are straight, the pipes tend to separate from the recess 10 or the cylindrical flange 52, in case they are not welded together or if the welding is broken, and further, the welding operation for these exhaust gas conducting pipes is very troublesome. Further, such a fixing construction as mentioned above has the disadvantages that the welded portions might be broken or the exhaust gas conducting pipes might be jolted or separate from the mating portions due to severe vibrations occuring in the main body or to thermal expansion of the main body caused by the passage of the high temperature exhaust gas therethrough or to the failure in the welded portion in the fixing construction.

Figure 28:
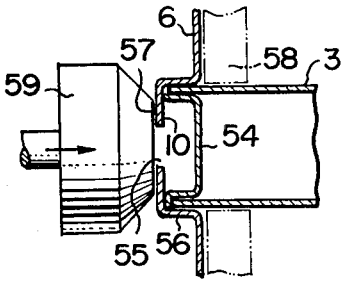
Figure 29:
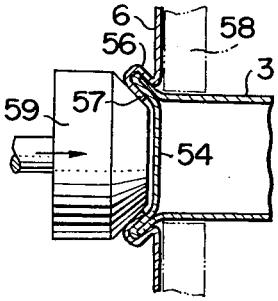

FIGS. 28 and 29 shows an embodiment of the fixing construction for the exhaust gas conducting pipes in the muffler constructed in accordance with the present invention for avoiding the above mentioned disadvantages.

As shown in FIG. 28, the open end of the outlet tube 3 with a dish-shaped flanged cap 54 fitted thereon is engaged in a cylindrical recess 10, the bottom 57 of said recess 10 having a hole 55 of a diameter less then the diameter of the pipe 3 at the center thereof. Then the bottom 57 of the recess 10 around the hole 55 is pressed into the end portion of the pipe 3 together with the cap 54 by means of a press member 59 as shown in FIG. 29. The tapered end of press member 59 produces a divergent configuration from the cylindrical portion 56, the end portion of the outlet pipe 3 and the cylindrical portion of the cap 54 so as to tightly secure the exhaust conducting pipe, the cap 54 and the end plate 6 to each other in sealing relation by the caulking step. The portion 51 shown in FIG. 27 may be secured in the similar manner as mentioned above.

Thus, the outwardly expanded end of the outlet pipe 3 and the cap 54 are tightly held between the cylindrical portion 56 of the recess 10 and the pressed bottom 57 of the recess 10 around the hole 55 so as to be completely closed and prevented from separating from the end plate 6.

In securing the pipe 3 and the cap 54 to the end plate 6 as mentioned above, the outlet pipe 3 is clamped by a chuck 58 with the cap 54 fitted on the open end of the pipe 3 and the pipe 3 is positioned at the inside of the end plate 6, and then the press member 59 having a tapered conical outer surface is pushed against the end plate 6 in the direction indicated by the arrow.

The above-mentioned manner for fixing the pipes to the plate and partitions is appropriately applied in manufacturing the muffler of the present invention depending on the construction thereof so that the assembly of the muffler of the present invention is greatly facilitated, while a rigid sealing effect is achieved. The fixing of the exhaust gas-conducting pipe at the intermediate portion thereof is effected in the conventional manner by passing the pipe through the cylindrical flange formed in the end plate or the partition so as to be supported thereby.

In accordance with the present invention as mentioned above, a caulked edge portion 57 is provided in the end plate of the partition for preventing the separating of the pipe therefrom, the exhaust gas conducting pipe can be securely fixed to the main body of the muffler, and the securing of the pipe can be simply effected by the pressing operation thereby affording practical convenience.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of generic and specific features of the invention herein described, and all statements of the scope of the invention which, as a matter of language, might be said to fall therebetween.

What is claimed is:

1. A muffler for attenuating sound pulsations in exhaust gas, comprising a sealed main body, including a curved housing of circular or elliptical cross-section and forward and rear end plates joined to said housing, said housing and end plates forming a principal chamber, each of said end plates having an aperture therein spaced apart from said curved housing, inlet pipe means traversing said aperture in said forward end plate sealingly for introduction of gas into said chamber, that part of said inlet pipe means within said chamber having a forward and a rearward portion and a downstream end on said rearward portion, and outlet pipe means traversing said aperture in said rear end plate for exhausting gas from said chamber, that part of said outlet pipe means within said chamber having a forward and a rearward portion and an upstream end on said forward portion extending to said forward plate, said inlet pipe means becoming narrower toward the downstream end thereof forming a narrower cylindrical wall which extends to said rear end plate, and said outlet pipe means having at least one opening in the cylindrical wall thereof, said outlet pipe means passing through the wall of the principal chamber at which said inlet pipe terminates.

2. A muffler as defined in claim 1 wherein said outlet pipe means has a plurality of openings in the forward portion thereof.

3. A muffler as defined in claim 2 wherein said upstream end of said outlet pipe means is sealingly joined to said forward end plate of said housing.

4. A muffler as defined in claim 1, further comprising a partition dividing said housing into forward and rearward chambers and having first and second apertures therein, said narrower cylindrical wall of said inlet pipe means being disposed entirely within said rearward chamber, said inlet pipe means traversing said forward chamber and passing through said first aperture and having an opening in that portion of same within said forward chamber for flow of exhaust gas from said inlet pipe means to said forward chamber, said inlet pipe means being sealingly joined around the periphery thereof to said partition at said first aperture, said outlet pipe means terminating at the upstream end thereof at said partition and being sealingly joined around the periphery thereof to said partition at said second aperture therein, thereby providing for flow of exhaust gas from said opening in said inlet pipe means within said forward chamber, through said forward chamber and into said upstream end of said outlet means.

5. A muffler as defined in claim 1, wherein the number of outlet pipe means in said muffler is at least two, the upstream end of each of said outlet pipe means being sealingly joined to said upstream end plate of said housing.

6. A muffler as defined in claim 1, wherein said forward portion of said inlet pipe means is convergingly tapered and has a plurality of apertures therein.

7. A muffler as defined in claim 6, wherein said outlet pipe means has a forward portion and a rearward portion and has a plurality of apertures in said forward and rearward portions.

8. A muffler as defined in claim 7, wherein said rearward portion of said outlet pipe means is divergingly tapered.

9. A muffler as defined in claim 1, wherein the number of said outlet pipe means is at least two, each of said outlet pipe means has a forward and a rearward portion, each of said forward and rearward portions of said outlet pipe means has a plurality of apertures therein and the upstream end of each of said outlet pipe means is sealingly joined to said forward end plate.

10. A muffler as defined in claim 1, wherein the downstream end of said inlet pipe has a plurality of apertures in the narrower cylindrical portion.

11. A muffler for attenuating sound pulsations in exhaust gas, comprising a sealed main body, including a curved housing of circular or elliptical cross-section and forward and rear end plates joined to said housing, said housing and end plates forming a chamber, each of said end plates having an aperture therein spaced apart from said housing, inlet pipe means traversing said aperture in said forward end plate sealingly for introduction of gas into said chamber, that part of said inlet pipe means within said chamber having a forward and a rearward portion and a downstream end on said rearward portion, and outlet pipe means tranversing said aperture in said rear end plate for exhausting gas from said chamber, that part of said outlet pipe means within said chamber having a forward and a rearward portion and an upstream end on said forward portion extending to said forward end plate, said inlet pipe means becoming narrower toward the downstream end thereof, and said downstream end having at least one opening for exiting exhaust gas.

12. A muffler as defined in claim 11 wherein said downstream end of said inlet pipe is spaced apart from said rear end plate and the opening is the cylindrical end of said pipe.

13. A muffler as defined in claim 11, further comprising a partition dividing said housing into forward and rearward chambers and having first and second apertures therein, said narrower cylindrical wall of said inlet pipe means being disposed entirely within said rearward chamber, said inlet pipe means traversing said forward chamber and passing through said first aperture and having an opening in that portion of same within said forward chamber for flow of exhaust gas from said inlet pipe means to said forward chamber, said inlet pipe means being sealingly joined around the periphery thereof to said partition at said first aperture, said outlet pipe means terminating at the upstream end thereof at said partition and being sealingly joined around the periphery thereof to said partition at said second aperture therein, thereby providing for flow of exhaust gas from said opening in said inlet pipe means within said forward chamber, through said forward chamber and into said upstream end of said outlet means.

14. A muffler as defined in claim 13 wherein said downstream end of said inlet pipe is spaced apart from said rear end plate and the opening is the cylindrical end of said pipe.

* * * * *